US005825122A

United States Patent [19]

Givargizov et al.

[11] Patent Number: 5,825,122

[45] Date of Patent: Oct. 20, 1998

[54] FIELD EMISSION CATHODE AND A DEVICE BASED THEREON

[76] Inventors: Evgeny Invievich Givargizov, 117421, ul. Obrucheva 20, kv. 12; Viktor Vladimirovich Zhirnov, 121609, Rublevskoe shosse 44, kor. 2, kv. 335; Alla Nikolaevna Stepanova, 119270, 3-ya Frunzenskaya ul. 9, kv. 149; Lidiya Nikolaevna Obolenskaya, 117279, ul. Profsojznaya 105, kv. 175, all of Moscow, Russian Federation

[21] Appl. No.: 619,704

[22] PCT Filed: Jul. 18, 1995

[86] PCT No.: PCT/RU95/00154

§ 371 Date: Mar. 26, 1997

§ 102(e) Date: Mar. 26, 1997

[87] PCT Pub. No.: WO96/03762

PCT Pub. Date: Feb. 8, 1996

[30] Foreign Application Priority Data

Jul. 26, 1994 [RU] Russian Federation ..... 94027731/07

[51] Int. Cl.[6] ..... H01J 1/30

[52] U.S. Cl. ..... 313/336; 313/309; 313/351

[58] Field of Search ..... 313/309, 336, 313/351, 495

[56] References Cited

U.S. PATENT DOCUMENTS 3,814,968 6/1974 Nathanson et al. ..... 313/309

5,204,581 4/1993 Andreadakis et al. ..... 313/336

5,600,200 2/1997 Kumar et al. ..... 313/310

*Primary Examiner*—Sandra L. O'Shea

*Assistant Examiner*—Vip Patel

*Attorney, Agent, or Firm*—Knobbe, Martens, Olson & Bear, LLP

[57] ABSTRACT

A matrix field-emission cathode (5) comprises a monocrystalline silicon substrate (7) on which are arranged epitaxially grown pointed silicon emitters (1) which also act as ballast resistors connected in series to the emitters. In an advantageous embodiment of the proposed cathode, for a radius of curvature (r) at the emitter tip not exceeding 10 nm, the ratio of the height (h) of the emitter to the radius (r) is not less than 1000, while the ratio of height (h) to the diameter (D) at the emitter base is not less than 1. The angle α at the emitter tip does not exceed 30°. The specific resistance of the emitter material is chosen so as to ensure that the resistance of each emitter will be comparable with the resistance between the cathode and the opposing electrode. The proposed cathode is used in an electronic device for displaying information which also has an anode (3) in the form of a strip (11) of phosphorescent material (10) and a conducting layer (9) whose projection onto the cathode (5) is perpendicular to the conducting paths (6) on the cathode; the anode itself acts as the control electrode.

19 Claims, 8 Drawing Sheets

✱✱✱✱✱ h=100 μm r=10 nm φ=4.5 eV
△△△△△ h=100 μm r=10 nm φ=2.5 eV
×××××× h=100 μm r=10 nm φ=1 eV

***** h=100 μm r=10 nm φ=2.5 eV
ΔΔΔΔΔ h=50 μm r=10 nm φ=2.5 eV
××××× h=10 μm r=10 nm φ=2.5 eV

FIELD EMISSION CATHODE AND A DEVICE BASED THEREON

FIELD OF THE INVENTION

The present invention relates to field-emission devices and vacuum microelectronics, and more particularly to field-emission cathodes including cathodes with diamond coatings ensuring decreased effective electron work function, as well as to flat-panel field-emission displays, to electron sources for various electron guns, etc.

BACKGROUND OF INVENTION

Cathodes for field-emission electronics and vacuum microelectronics represent, as a rule, regular tip arrays prepared by means of photolithography, etching, evaporation through a mask, etc.

It is known a field-emission cathode formed of silicon tips prepared in the body of a single-crystalline silicon wafer by etching (H. F. Gray et al., U.S. Pat. 4,307,507, 1981). A shortcoming of such a cathode is that the height of the emitters is inherently not-large, typically several micrometers, that does not allow to have high field enhancement. In addition, the emitter material has relatively large value of work function (4–5) eV. Such a cathode can ensure sufficiently high electron currents at either high voltages or at a small distance between the emitters and an extracting electrode. The latter increases parasitic capacity of the devices limiting possibilities of their applications. In addition, field emission from such cathodes is not uniform.

In order to improve the uniformity of the field emission from various emitters in multiple-emitter matrix, it is common to use an additional resistance that is comparable with the differential resistance of the vacuum gap and introduced in series with each of the emitters. Its action is based on the following: if current flowing through a given emitter is larger than that through other ones, a voltage drop on it is larger and, accordingly, the extracting voltage is decreased resulting in a decrease of the large current flowing. Such an approach is used in patents by Meyers (France Pat. No. 8,411,986, 1985, and U.S. Pat. No. 4,908,539, 1990), where the additional ("ballast") resistor is provided by deposition of amorphous silicon film, having a high specific resistivity, onto an insulating substrate, while emitting tips (molybdenum cones) are deposited on the amorphous film. However, the use of the amorphous film limits substantially possibilities for preparation of emitters, particularly of semiconductor ones, because the existing semiconductor technologies need in rather high temperatures at which the amorphous silicon is spontaneously crystallized and losses its high resistivity.

It is known a matrix field-emission cathode that consists of single-crystalline silicon substrate and an array of tips that have series ballast resistances prepared integrally by selective impurity diffusion (R. Kane, U.S. Pat. No. 5,142,186, 1992). In such a design, the ballast resistance takes a significant area at the substrate where other emitters could be arranged. In addition, the technology for preparation of the resistances needs in several photolithography procedures with fitting operations that complicates the process for fabrication of field emitters and makes it more expensive.

It is known an electron device(display) that has a diode design consisting of a flat cathode prepared from diamond or diamond-like carbon and an opposite anode with a phosphor (C. Xie, N. Kumar et al., Electron field emission from amorfic diamond thin film, A paper at 6th Intern. Conf. Vacuum Microelectronics, July 1993, Newport, R.I., USA).

For an effective operation of such a display, rather high voltages (several hundreds volts ) are necessary that hardly compatible with working voltages of other electronic parts of the display. In addition, field-emission properties of the diamond film are difficult to reproduce because they depend strongly on preparation conditions. Finally, in order to obtain sufficient emission currents, anode-to-cathode distances must be small, about 20 $\mu$m or less; that makes it difficult to pump gaseous contaminations evolving by the phosphor.

It is known a display having a matrix field-emission cathode with tip emitters arranged on an single-crystalline silicon substrate that contains conductive stripes formed by doping, gate electrode, ballast resistors, and an anode with a phosphor (N. N. Chubun et al, Field-emission array cathodes for a flat-panel display, Techn. Dig. IVMC-91, Nagahama, Japan, 1991.). In the device, the tip emitters (Mo cones) were formed on an n-type single-crystalline silicon substrate with the stripes formed by doping with acceptor impurity. This means that, there, an isolation by p-n junction was realized. Gating columns (as Mo-film stripes) were placed on the cathode, too, normal to the conductive stripes (lines) being isolated by a dielectric film. In order to increase uniformity of field-emission current from the emitters, discrete ballast resistors were introduced in series with each of the lines that decreased scattering of brightness along the columns within 15%. However, in such a way, it is impossible to control brightness along the lines. In addition, such a design is rather cumbersome and not suitable for high-resolution displays.

DISCLOSURE OF THE INVENTION

The aim of the invention is to design a field-emission cathode that has lower working voltages, is operative under relatively poor vacuum conditions, and ensures a high emission uniformity over a large area. Another aim of such a design is to ensure a high uniformity on all over the display, and low parasitic capacity of display, based on the cathode.

The aim is reached in a matrix field-emission cathode that contains a single-crystalline silicon substrate and an array of silicon tip emitters upon the substrate, the emitters being made of silicon whiskers epitaxially grown on the substrate and serving as ballast resistors.

In the cathode, ratios of the heights of the emitters h to their radii of curvature at the tip ends r are 1000, or more the radii being less than 10 nm, while ratio of h to the diameter of the emitters at the base D is 10 or more.

Angles $\alpha$ at the ends are preferentially less than 30°.

The specific resistivity of emitter material is chosen so that the resistance of each emitter would be comparable with resistance of the vacuum gap between the emitter and gate electrode.

Ends of the tip Si emitters can have coatings of materials decreasing electron work function, for example, of diamond while curvature radii of the coating are from 10 nm to 1 $\mu$m.

A preferential diameter D is 1 to 10 $\mu$m, while the specific resistivity of the material is 1 Ohm-cm or more.

The large height and the small curvature radius of the field emitters give large field enhancement; at the same time, the diamond coatings having low work functions, together with geometrical characteristics of the emitters, ensure low working voltages and decrease demands to vacuum conditions.

Another aim of the invention is reached in the display containing a matrix field-emission cathode with tip emitters on a single-crystalline substrate with conductive doped stripes, a gate electrode, ballast resistors and an anode with phosphor and conducting layer, the matrix field-emission cathode is formed by tip Si emitters prepared of whiskers epitaxially grown on the substrate, the emitters serve as the ballast resistors, while the anode is implemented as stripes perpendicular to the conductive strips of the cathode and serves as the gate electrode.

BRIEF DESCRIPTION OF DRAWINGS

The invention is illustrated by the following figures.

FIG. 5*b*–A micrograph of matrix, field-emission cathode of regular array of emitters with diamond particles on the emitter tips.

FIG. 6*b*—A scheme of the silicon tip arrays of FIG. 6*a* with single particles on the tips.

FIG. 6*c*—A scheme of the silicon tip arrays of FIG. 6*a* with the tips coated by an almost continuous layer of diamond particles.

FIG. 6*d*—A scheme of the silicon tip arrays of FIG. 6*a* with the tips coated by diamond-like material.

FIG. 7—A scheme of display.

BEST VERSION OF THE INVENTION

Figure 1:
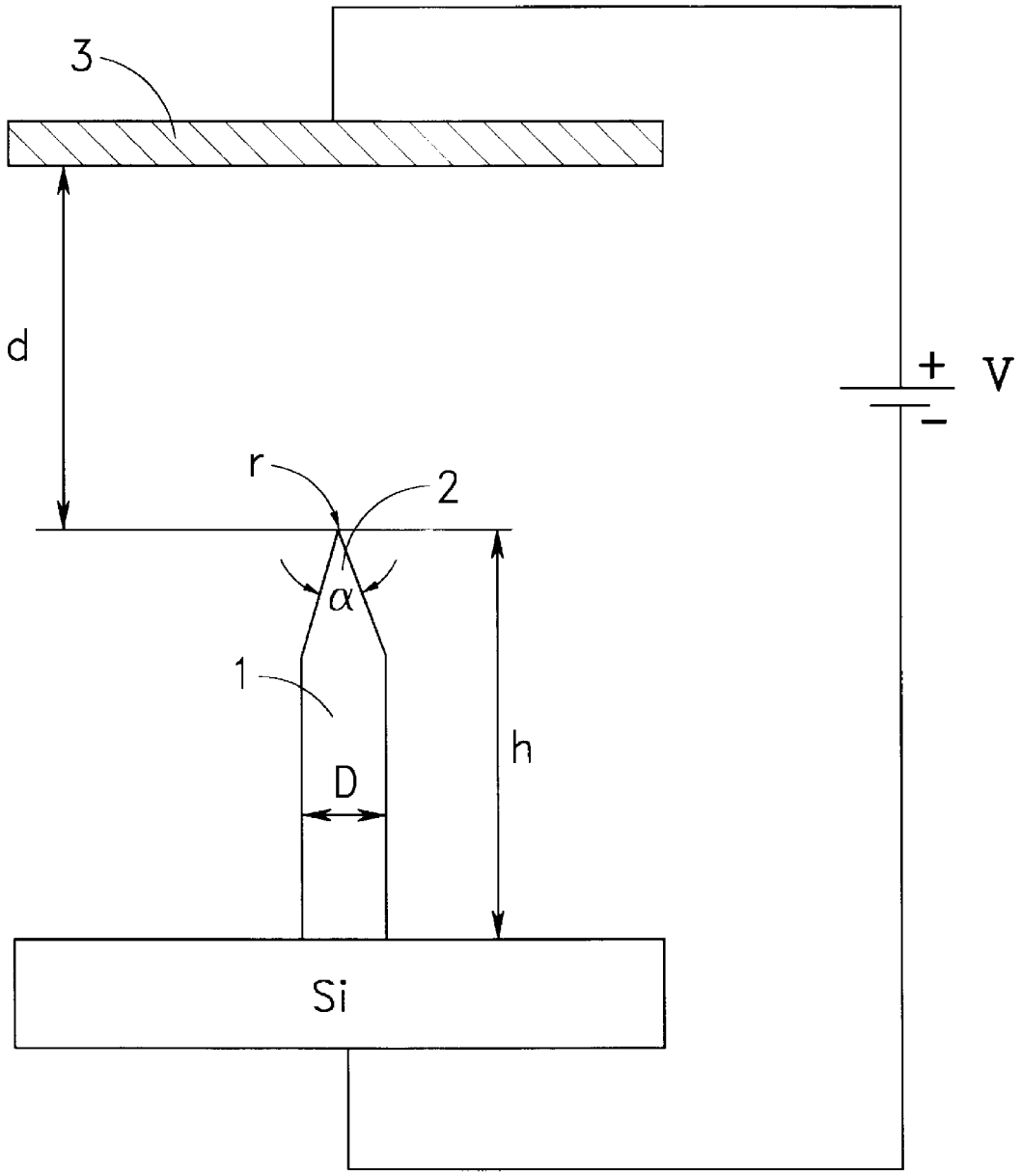
FIG. 1—Silicon tip emitter prepared of a whisker.

In FIG. 1, a tip emitter (1), prepared of silicon whisker is shown. Field-emission current I (A) of such an emitter depends on work function $\phi$ (eV) of the material at the top (2) of the emitter (1), radius of curvature of the tip r (nm), its height h ($\mu$m), distance d (mm) between the anode (3), and the emitter (1), and on voltage V (Volts) at the anode-cathode gap according to the equation:

$$I=(K_1/\phi)(fhV/rd)^2\exp\left[-K_2 rd\phi^{3/2}/fhV\right] \quad \{1\}$$

where $$K_1=1.4\ 10^{-6},\ K_2=6.83\times10^7\ (0.95-1.48\times10^{-7}\ E/\phi^2),$$

where f is the coefficient of ideality of the emitter that depends on the ratio of the emitter height to the emitter diameter D at its basis and on the angle $\alpha$ of tip cone; E is electrical field strength.

It is seen from the formula {1} that the ratio h/r is one of the most important parameters that influence the emission current. At the emitter height more than 10 $\mu$m and the radius less than 10 $\mu$m, the value h/r is more than 1000 for an ideal emitter.

Another important factor in the {1} is f, a "coefficient of ideality of emitter". For an ideal emitter f=1, real emitters have f from 0.1 to 0.8 depending on their shape. Calculations by T. Utsumi (T. Utsumi, Vacuum microelectronics: what's new and exciting, IEEE Trans. Electron Devices 38, 2276, 1991) show that in order to reach maximal values of f, it is necessary to use emitters with ratio of the emitter height to the basis diameter as large as possible (for example, 10 to 100) and with low angles $\alpha$ (for example, 15° to 20°)

Figure 2:
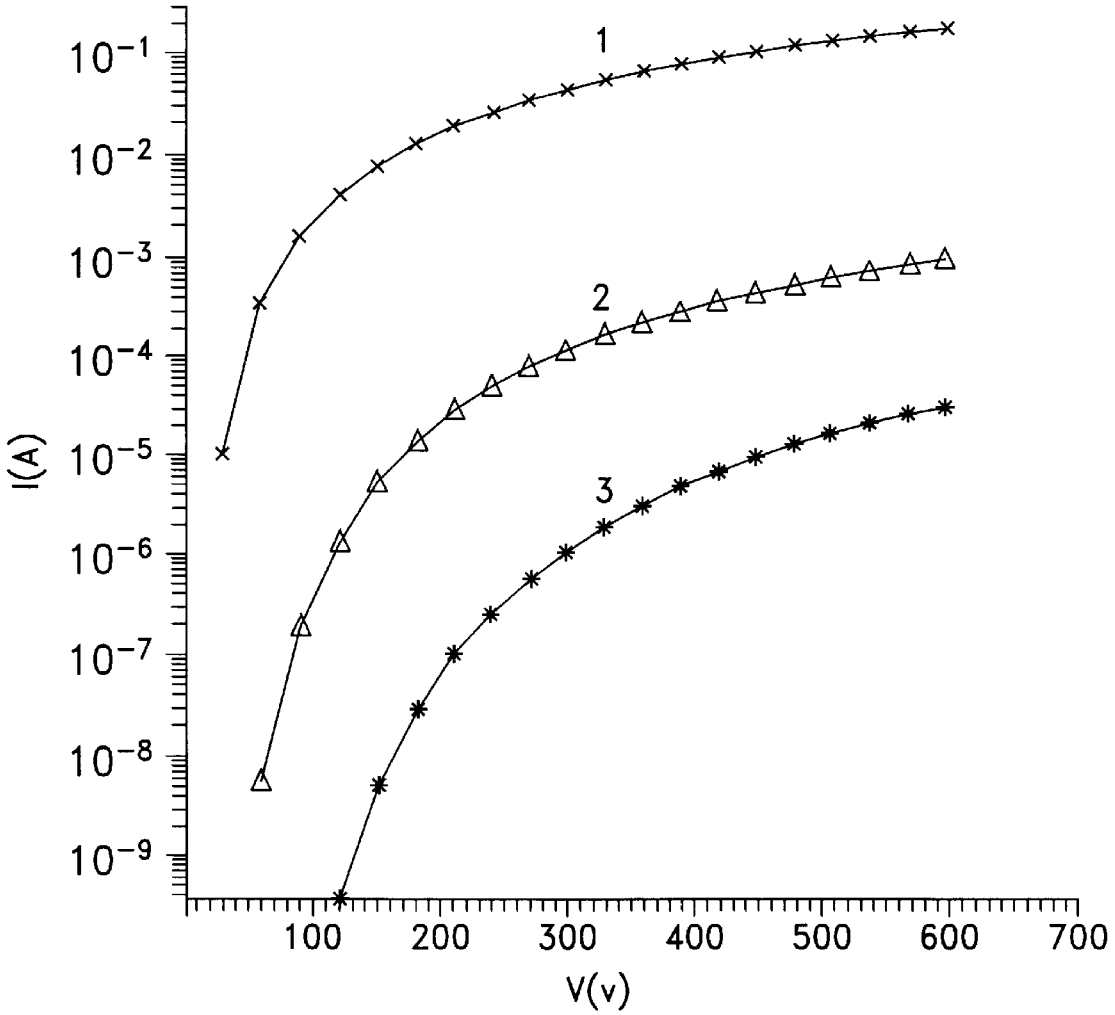
FIG. 2—Current-voltage characteristics of emitters with diamond particles and without them.

Another important parameter for the emission is the value of the effective work function $\phi$. By decreasing $\phi$ it is possible, firstly, to decrease the operation voltage and, secondly, to decrease influence of differences in curvature radii and heights of emitters on uniformity of emission from arrays. In order to lower the work function of the emitters, it is possible to deposit onto the emitters a material decreasing the work function, for example, diamond, or diamond-like material. It is known (F. J. Himpsel et al.,. Quantum photoyield of diamond (111)—a stable negative-affinity emitter, Phys. Rev. B20, 624, 1979) that the face (111) of diamond has negative electron affinity that allows to obtain values of effective work function less than 2 eV (E. I. Givargizov et al., Microstructure and field emission of diamond particles on silicon tips, Appl. Surf. Sci. 87/88, 24, 1995). In FIG. 2 three current-voltage (I–V) plots of emitters of FIG. 1 are given: with diamond particle on the tip for work function of 1 eV (1), 2.5 eV (2), and without diamond coating for $\phi$=4.5 eV (3). In all the cases, the height of emitters is 100 $\mu$m, and the curvature radius of the tip is 10 nm. FIG. 2 illustrates a possibility to obtain large currents at rather low operation voltage from emitters with diamond particles, that exceed strongly field-emission currents that could be obtained without such particles.

Figure 3:
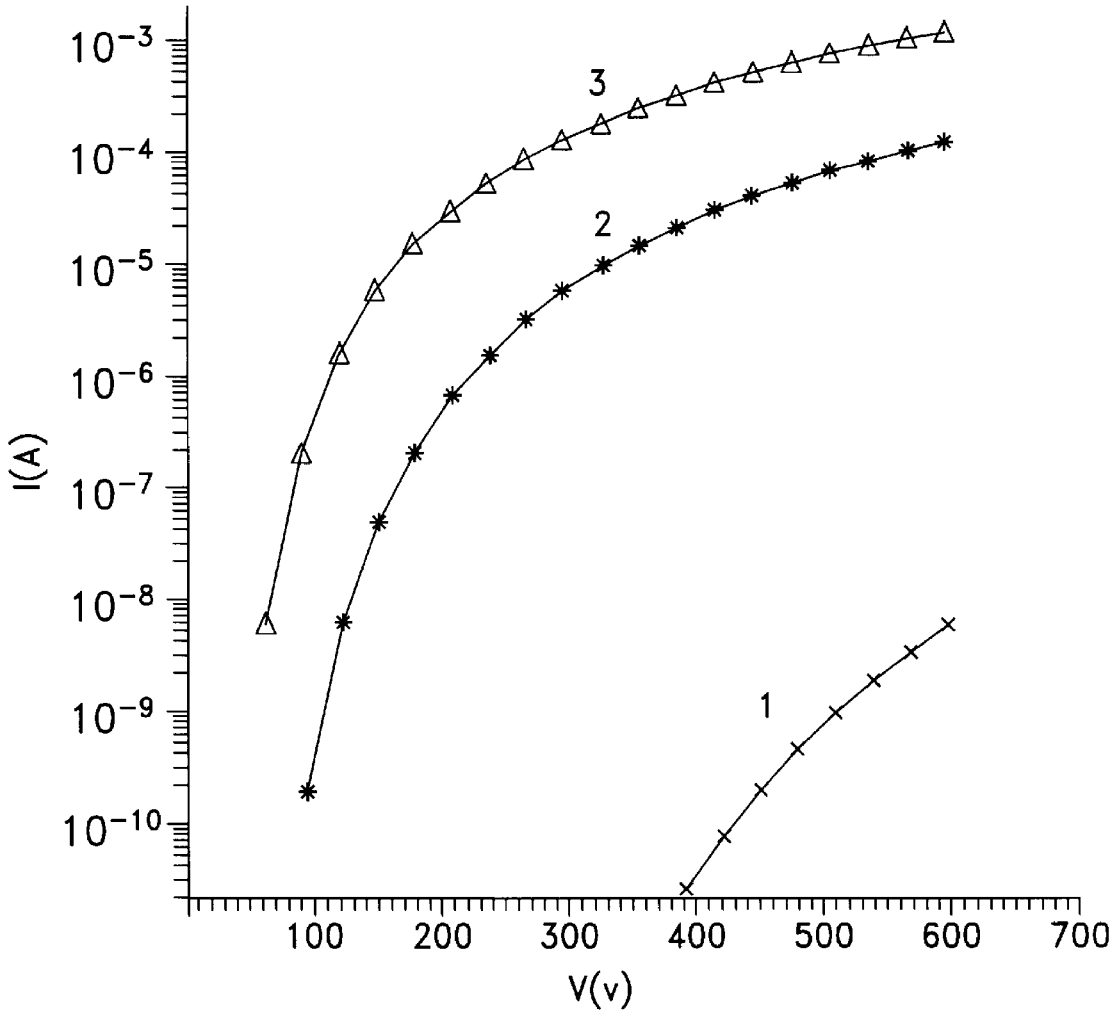
FIG. 3—Current-voltage characteristics of diamond-coated emitters having different heights.

In FIG. 3, are given I–V plots of field emitters with diamond particle, having effective size of 10 nm for different emitter heights: 10 $\mu$m (1), 50 $\mu$m (2), and 100 $\mu$m (3), at $\phi$=2.5 eV. These characteristics indicate to significant increase of the emission current at the same voltage with increase of the emitter height.

Figure 4A:
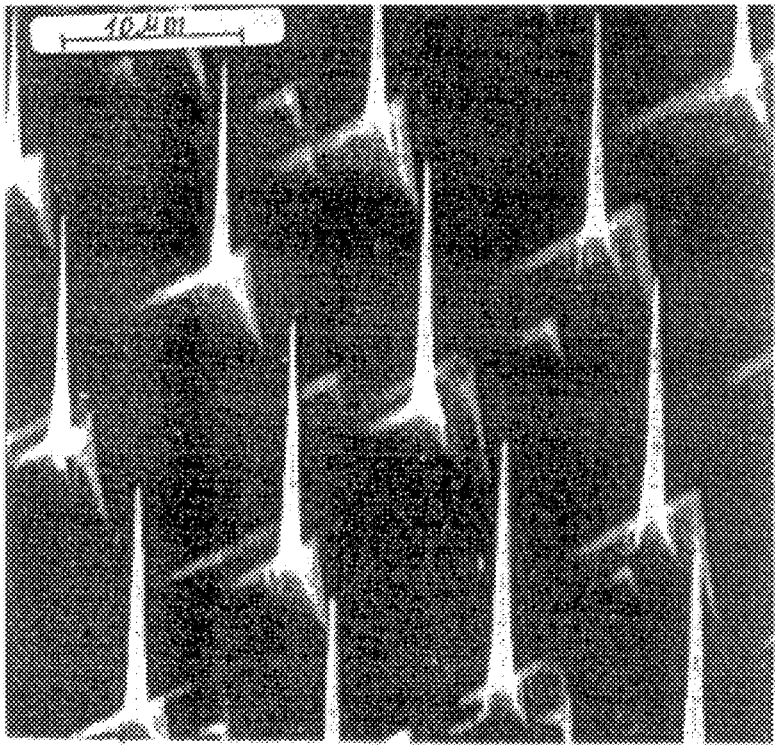
FIG. 4*a*—Matrix field-emission cathodes prepared by sharpening of whisker arrays.
Figure 4A:
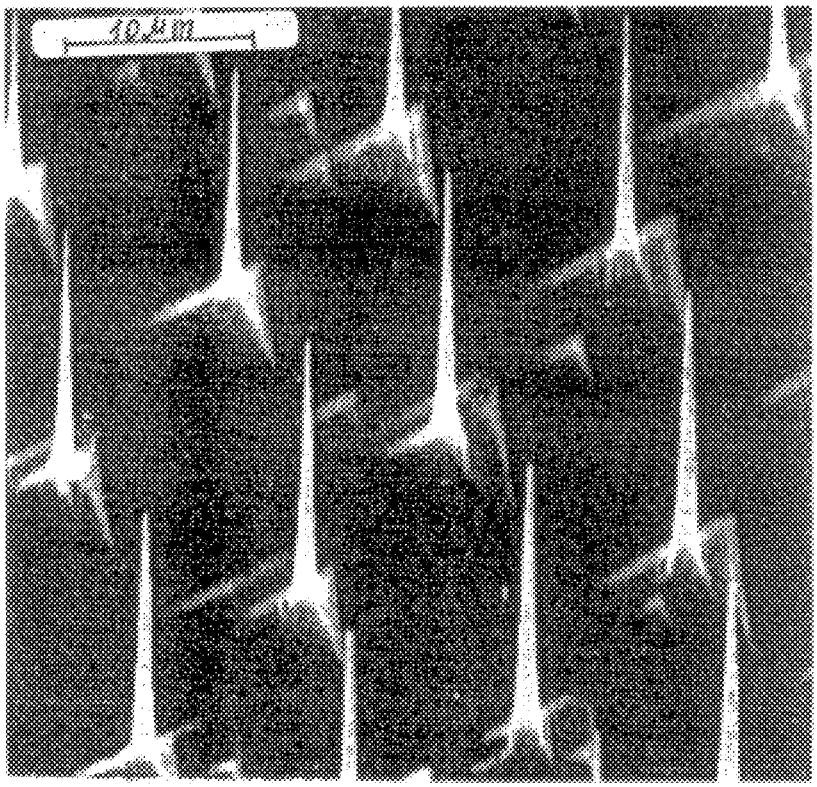
Figure 5B:
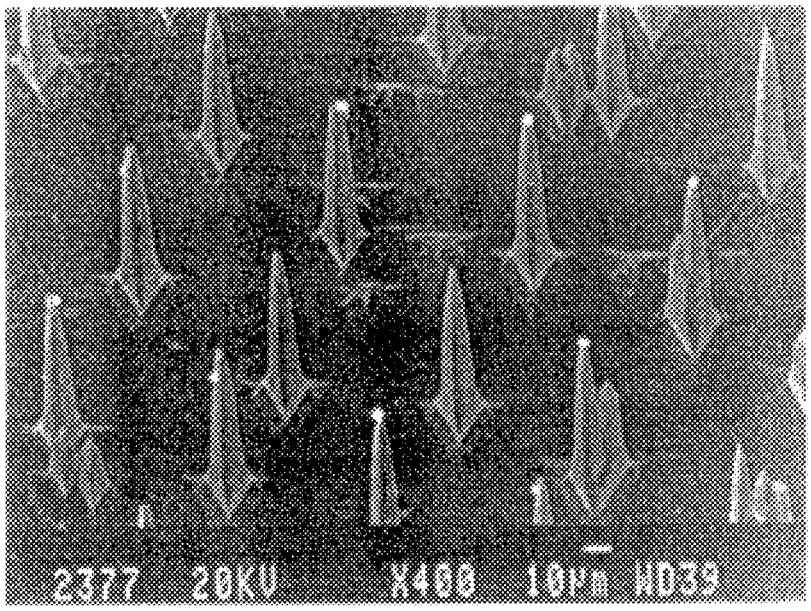
Figure 4A:
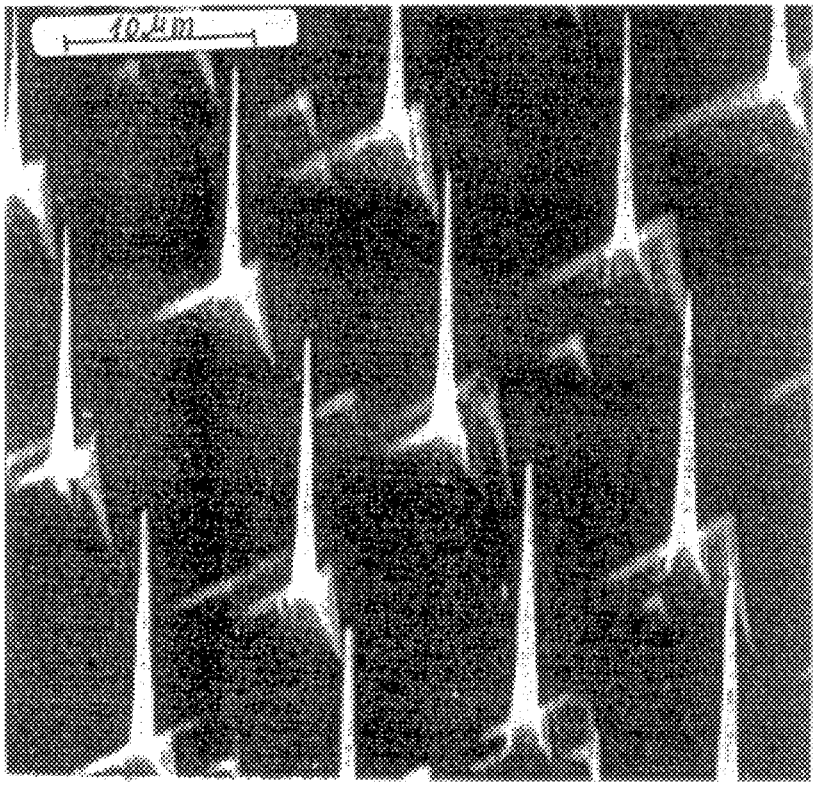
Figure 5B:
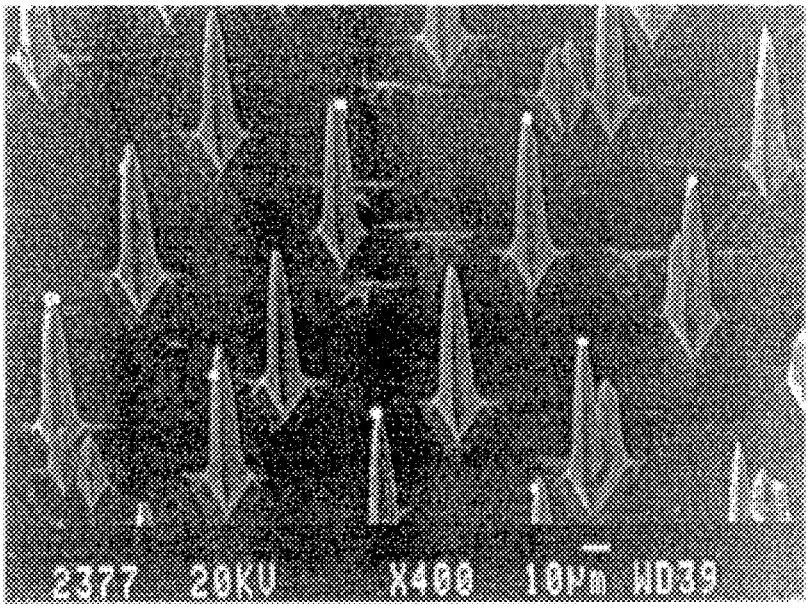

In FIG. 4, examples of tip arrays prepared from grown whiskers are shown. Field-emission cathodes with such arrays can have areas of several square centimeters with tip density of $10^4$ to $10^6$ $cm^{-2}$. Multiple-tip field-emission cathodes allow to obtain, at relatively low voltages and at independent action of different emitters, a large current that equals to the current of single emitter multiplied by number of emitters.

Figure 5B:
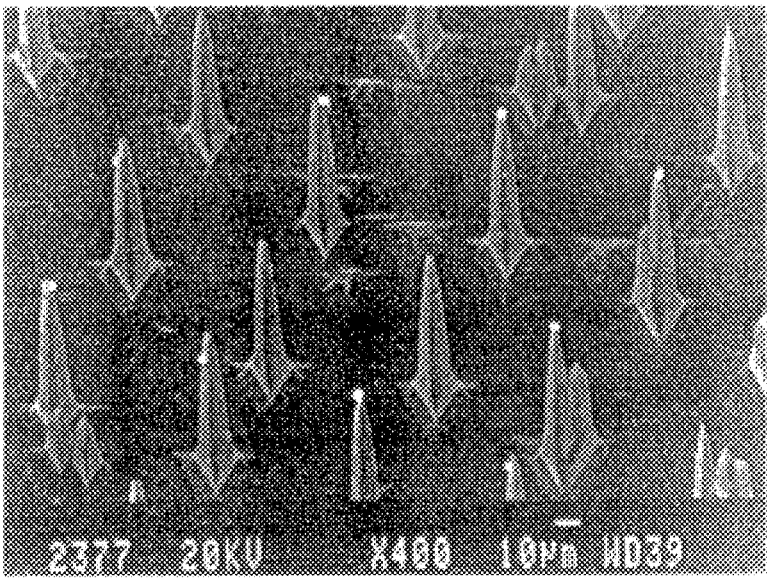
Figure 5A:
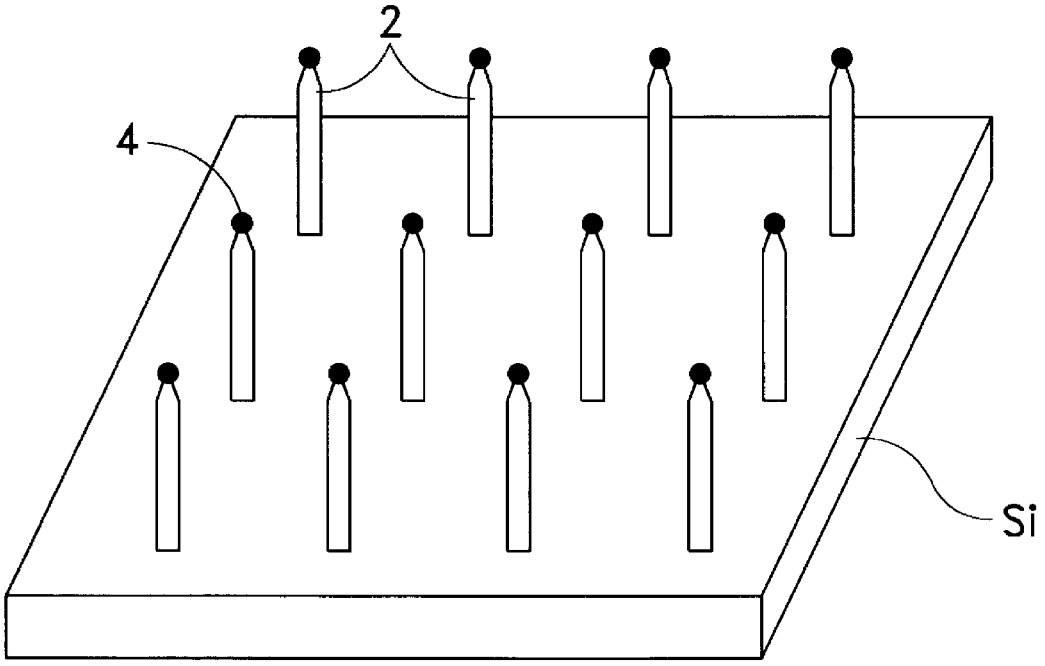
FIG. 5*a*—A scheme of matrix field-emission cathode consisting of regular array of emitters with diamond particles on tips.
Figure 6A:
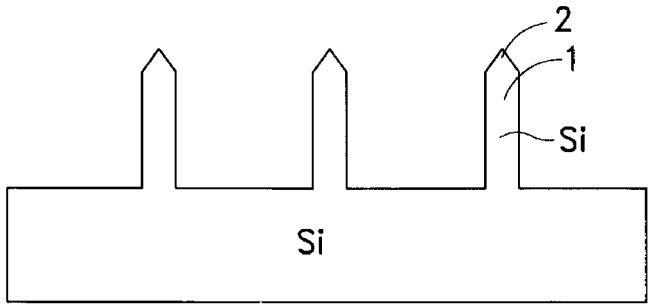
FIG. 6*a*—A scheme of silicon tip arrays of the present invention.
Figure 6B:
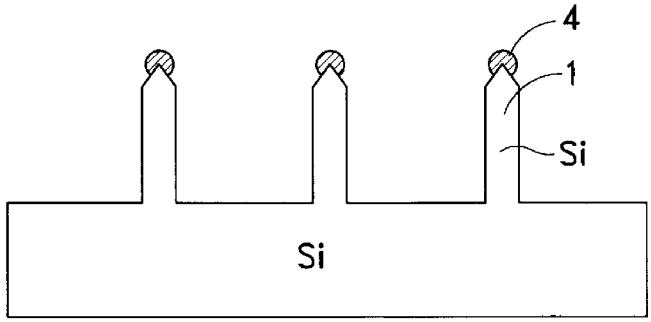
Figure 6C:
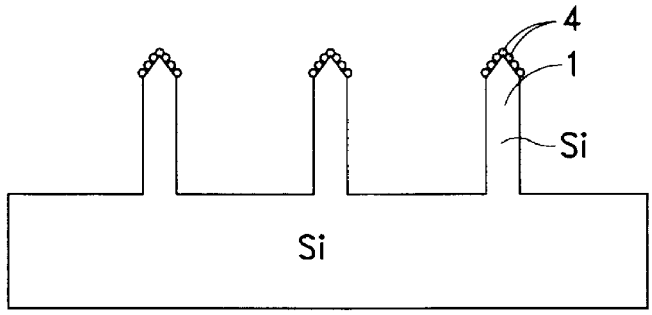
Figure 6D:
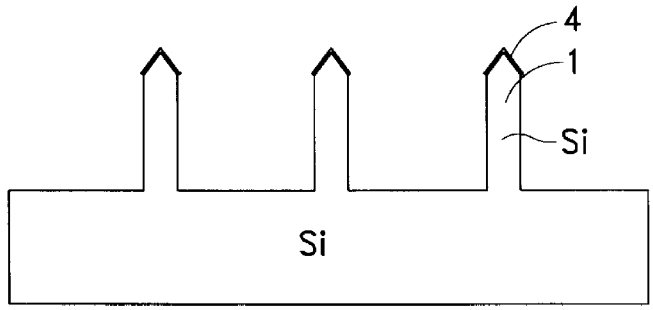

In FIGS. 5*a* and 5*b* are given a scheme and a micrograph of tip emitters with diamond particles (4) on their ends (2). In FIGS. 6*a*, 6*b*, 6*c* and 6*d* are given schemes of various diamond coatings: with single particles (FIG. 6*b*), with ends coated by almost continuous layer of fine diamond particles (FIG. 6*c*), and with a film of diamond-like material (FIG. 6*d*).

At deposition of diamond or diamond-like material onto tips, their radii of curvature are certainly increased, for example, up to 1 $\mu$m. This increase of the radius can be partly or completely compensated by decrease of the work function, as it was proved by direct experiments.

In order to improve uniformity of the field emission of a multiple-tip cathode on a large area it is desirable each emitter to have electrical resistance comparable with that of vacuum gap (typically, this is a value about $10^6$–$10^7$ Ohm). Such a large resistance of an emitter can be reached at a suitable choice of its geometrical characteristics (a small cross-section D, a significant height h, a small angle at the end $\alpha$ that involves elongation of the conical part) and at suitable doping level (specific resistivity $\rho$). The resistance can be calculated according to the expression $R=4h\rho/\pi D^2$ (supposing a cylindrical shape of the emitter).

An example of the calculation of the emitter resistance: at the cross-section area 1 $\mu m^2$, height 50 $\mu$m and specific resistivity 10 Ohm-cm, resistance of the emitter is about $5\times10^6$ Ohm. The conical shape of the emitter contributes an additional resistance. Further increase of the resistance is possible by increase of the specific resistivity. It is known, that at crystallization of silicon from the vapor phase it is possible to obtain a material with a specific resistivity up to 100 Ohm-cm. An additional factor in controlling of resistance of the emitter is its doping with such an impurity as gold that is commonly (as here) used as an agent for growing of whiskers by the vapor-liquid-solid mechanism (others are related transient elements such as copper, silver, nickel, palladium etc.). It is known that gold is a compensating impurity that ensures a high specific resistivity of silicon.

Finally, in FIG. 7 is shown a display that includes the matrix field emission cathode (5) according to FIGS. 4, 5*a* and 5*b*, where silicon tip emitters (1) are implemented on linear(striped) $n^+$-areas (6) prepared by doping in silicon p-type substrate (7). To each of the linear $n^+$-type areas (6), as well as to the p-type substrate (7) an electrical contact (8) is made. At a distance 0.1–1 mm of the cathode (5) is placed an anode (3) where optically-transparent conductive layer (9) and phosphor (10) are made as linear (striped) areas (11) whose projections on the silicon substrate (7), a cathode basis, are perpendicular to the linear $n^+$-areas (6). To each of linear area (11) of the anode (3), that includes the conductive layer (9) and phosphor (10), an electrical contact (12) is made. At applying of voltage from an external source (13) between two chosen linear areas (11) of anode (3) and (6) of cathode (5), a small area of the anode is shining. In order to avoid electrical connection between different areas of the cathode, a small (several Volts) voltage $V_{rev}$ in reverse direction between the linear $n^+$-type area (6) and p-type substrate (7) is established.

In this design, the anode implements functions of a gate electrode.

The device can serve as a field-emission flat panel display without a close-spaced gate electrode.

The diamond coating (4) of emitter tip (2) allows to increase the electron emission (at a given field strength at the tip) and to improve its stability and robustness against destroying and deterioration of its properties.

Industrial applications.

The invention can be used in TV, computers and other information devices in various areas of applications.

What is claimed:

1. A matrix field-emission cathode comprising a single-crystalline silicon substrate and an array of silicon tip emitters located on the silicon substrate, wherein the silicon tip emitters are made of silicon whiskers epitaxially grown on the single-crystalline silicon substrate and each of the emitters also functions as a ballast resistor and has a resistance greater than about $5\times10^4$ ohm.

2. The matrix field-emission cathode of claim 1 wherein the ratio of the height h of the emitter to the curvature radius r at the apex of the emitter is 1000 or more, and radius r is 10 nm or more.

3. The matrix field-emission cathode of claim 2 wherein the ratio of the height h of the emitter to the diameter D at its basis is 1 or more.

4. The matrix field-emission cathode of claim 3, wherein the angle at the emitter apex $\alpha$ is 30° or less.

5. The matrix field-emission cathode of claim 2 wherein the angle at the emitter apex $\alpha$ is 30° or less.

6. The matrix field-emission cathode of claim 5 wherein the specific resistivity of the emitter material and the height h and the cross section of the emitter are chosen so that the resistance of each of the emitter is in the range of about $10^6$ to $10^7$ Ohm.

7. The matrix field-emission cathode of claim 1 wherein the apex of the silicon emitter has a coating that lowers the electron work function.

8. The matrix field-emission cathode of claim 7 wherein the coating is diamond or diamond-like material.

9. The matrix field-emission cathode of claim 8 wherein the curvature radius of the diamond coating at the apex is 10 nm to 1 $\mu$m.

10. The matrix field-emission cathode of claim 1 wherein the diameter D of the emitter is 1 to 10 $\mu$m, and the specific resistivity of the emitter material is larger than 1 Ohm-cm.

11. The matrix field-emission cathode of claim 1, wherein the height h of the emitters have a cross-sectional area of about 1 $\mu m^2$ at a middle point and at their basis along a longitudinal direction of the emitters.

12. A field emission display device comprising a matrix field emission cathode of silicon tip emitters located on conductive stripes formed on a surface of a single-crystalline silicon substrate, and an anode with phosphor and conductive layer formed on a surface of the anode, said surface of the single-crystalline silicon substrate and said surface of the anode being positioned facing and substantially parallel to each other, wherein each of the emitters also functions as a ballast resistor and has a resistance greater than about $5\times10^4$ Ohm, and the anode comprises stripes formed from said phosphor layer and conductive layer whose projections on the cathode are perpendicular to the conductive stripes.

13. A matrix field-emission cathode containing a single-crystalline silicon substrate and an array of silicon tip emitters located on the silicon substrate, wherein the silicon tip emitters are made of silicon whiskers epitaxially grown on the single-crystalline silicon substrate, and the ratio of the height h of the emitter to the diameter D at its basis is 1 or more.

14. The matrix field-emission cathode of claim 13, wherein the angle at the emitter apex $\alpha$ is 30° or less.

15. A matrix field-emission cathode containing a single-crystalline silicon substrate and an array of silicon tip emitters located on the silicon substrate, wherein the silicon tip emitters are made of silicon whiskers epitaxially grown on the single-crystalline silicon substrate, and the angle at the emitter apex $\alpha$ is 30° or less.

16. A matrix field-emission cathode containing a single-crystalline silicon substrate and an array of silicon tip emitters located on the silicon substrate, wherein the silicon tip emitters are made of silicon whiskers epitaxially grown on the single-crystalline silicon substrate, and the diameter D of the emitter is 1 to 10 $\mu$m, and the specific resistivity of the emitter material is larger than 1 Ohm-cm.

17. A matrix field-emission cathode comprising a single-crystalline silicon substrate and an array of silicon tip emitters located on the silicon substrate, wherein number density of the silicon tip emitters is about $2\times10^5$ $cm^{-2}$ or less.

18. The matrix field-emission cathode of claim 17, wherein the number density of the silicon tip emitters is in the range of about $2\times10^5$ to $10^6$ $cm^{-2}$.

19. A field emission display device comprising a matrix field emission cathode having a single-crystalline silicon substrate, said substrate having a first surface with silicon emitters located on and projected away from said first surface, an anode having a second surface facing and substantially parallel with the first surface of the substrate, said first and second surfaces forming a gap therebetween, wherein each of the silicon emitters has a resistance substantially equal to the resistance existing between the gap.

* * * * *